United States Patent [19]

Everett

[11] 4,411,400

[45] Oct. 25, 1983

[54] SHELVING SYSTEM

[75] Inventor: Lynn E. Everett, New Philadelphia, Ohio

[73] Assignee: Tusco Manufacturing Co., Gnadenhutten, Ohio

[21] Appl. No.: 245,998

[22] Filed: Mar. 20, 1981

[51] Int. Cl.[3] ..... E04G 3/00

[52] U.S. Cl. ..... 248/216.1; 108/47; 182/150; 248/243

[58] Field of Search ..... 248/216.1, 217.1, 243, 248/250, 217.3, 309.2, 243, 216.1; 108/47; 182/55, 87, 150

[56] References Cited

U.S. PATENT DOCUMENTS

| | | | |
|---|---|---|---|
| 225,345 | 3/1880 | Clark | 248/227 |
| 313,465 | 3/1885 | Worsley | 182/150 X |
| 698,227 | 4/1902 | Schrader | 248/217.1 |
| 836,045 | 11/1906 | Melchoir | 248/243 |
| 883,323 | 3/1908 | MacDuff | 248/250 |
| 1,260,123 | 3/1918 | Areson | 248/243 X |
| 1,334,891 | 3/1920 | Cutting | 248/217.1 |
| 2,570,731 | 10/1951 | Susnow | 248/250 |
| 2,709,562 | 5/1955 | Hamilton | 248/216.1 |
| 2,796,158 | 6/1957 | Miles et al. | 248/243 X |
| 3,017,155 | 6/1962 | Scarpetti | 248/325 |
| 3,134,567 | 5/1964 | Shoemaker | 248/243 |
| 3,207,100 | 9/1965 | Peacock | 248/250 X |
| 3,273,844 | 9/1966 | Hodson et al. | 248/216.1 |
| 3,510,097 | 5/1970 | McCaleb | 248/243 |
| 3,965,826 | 6/1976 | Markham | 248/243 |
| 4,145,849 | 3/1979 | Shindoll | 108/47 X |

*Primary Examiner*—James T. McCall

*Attorney, Agent, or Firm*—Wilson, Fraser, Barker & Clemens

[57] ABSTRACT

A shelving system for supporting horizontally disposed shelving adjacent a vertical wall surface having associated horizontally extending sill or the like at the upper extremity of the wall. The system includes vertically extending rail members having supporting and positioning means which are capable of puncturing or piercing the sill to achieve the supporting and positioning of the rail members.

17 Claims, 4 Drawing Figures

SHELVING SYSTEM

BACKGROUND OF THE INVENTION

Supplemental storage is a continuing paramount problem with home owners, retailers, business and commercial establishments, and many others. The ever-attendant suppliers of storage systems have presented to the marketplace shelving systems to meet the ongoing storage problems of the consumer.

The shelving systems available in the present marketplace typically are of the type which are sold in a knockdown configuration leaving the plight of the erection of the system to the purchaser. The typical steel shelf package includes a myriad of threaded fasteners, shelving components, and a scanty, at best, list of instructions. Considerable time is required for the process of the erection of the system and, often times, a fastener or two is missing from the kit or is lost in the excitement of the assemblage.

Once fully constructed, the problem of disassemblage and removing requires the same activities in reverse all to the consternation of the persons involved.

SUMMARY OF THE INVENTION

The present invention relates to a shelving or storage system which substantially eliminates the problems of the prior system. The resultant system of the invention is inherently extremely strong, easy and economical to install, and is rugged and rigid in use. The assemblage of the system incorporating the features of the invention requires no tools or particular expertise, and later may be removed and installed at a different site with the same ease. The system may readily be adopted to accommodate any anticipated load requirement.

The virtues of the invention are achieved by a shelving system for supporting horizontally disposed shelving adjacent a vertical wall surface having a horizontally extending sill wherein the system includes at least a pair of spaced-apart vertically extending rail members having aperture means formed therein for receiving shelving support brackets, the improvement comprises means for releasably securing the rail members to the horizontally extending sill which means include prong means integral with and spaced from the rail member and having an axis generally parallel to the vertical axis of the rail member and adapted to position and support the rail member adjacent the vertical wall beneath the sill.

BRIEF DESCRIPTION OF THE DRAWINGS

The above, as well as other objects of the invention, will become readily apparent to one skilled in the art from reading the following detailed description of a preferred embodiment of the invention when considered in the light of the accompanying drawings, in which.

DETAILED DESCRIPTION OF THE PREFERRED EMBODIMENT

Figure 1:
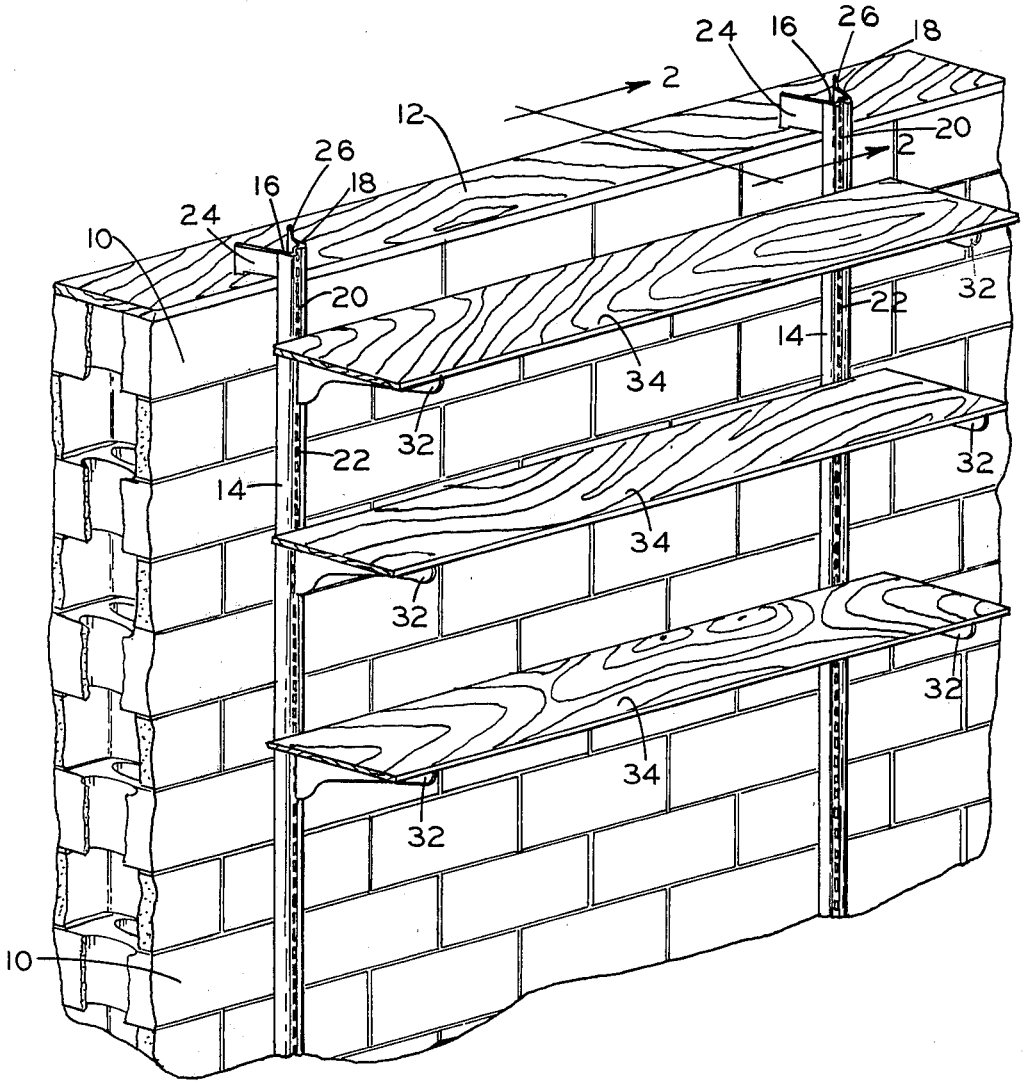
FIG. 1 is a fragmentary perspective view of shelving system incorporating the features of the invention.

Referring to the drawings wherein like reference numerals designate similar parts throughout, there is shown a shelving system for use adjacent a typical wall formed of cement block members 10 and having a horizontally extending plate 12 of wood disposed to extend along the uppermost course of the block members 10.

A pair of spaced-apart vertically extending rail members 14 are positioned adjacent the inner surface of the wall formed by the block members 10. The rail members include opposed side walls 16 and 18 which have their inner edges interconnected by a generally U-shaped, in cross-section, web 20. The web 20 is provided with a plurality of spaced-apart slots or apertures 22 adapted to receive the hook-like portions of cooperating brackets as will be hereinafter explained in detail.

Figure 2:
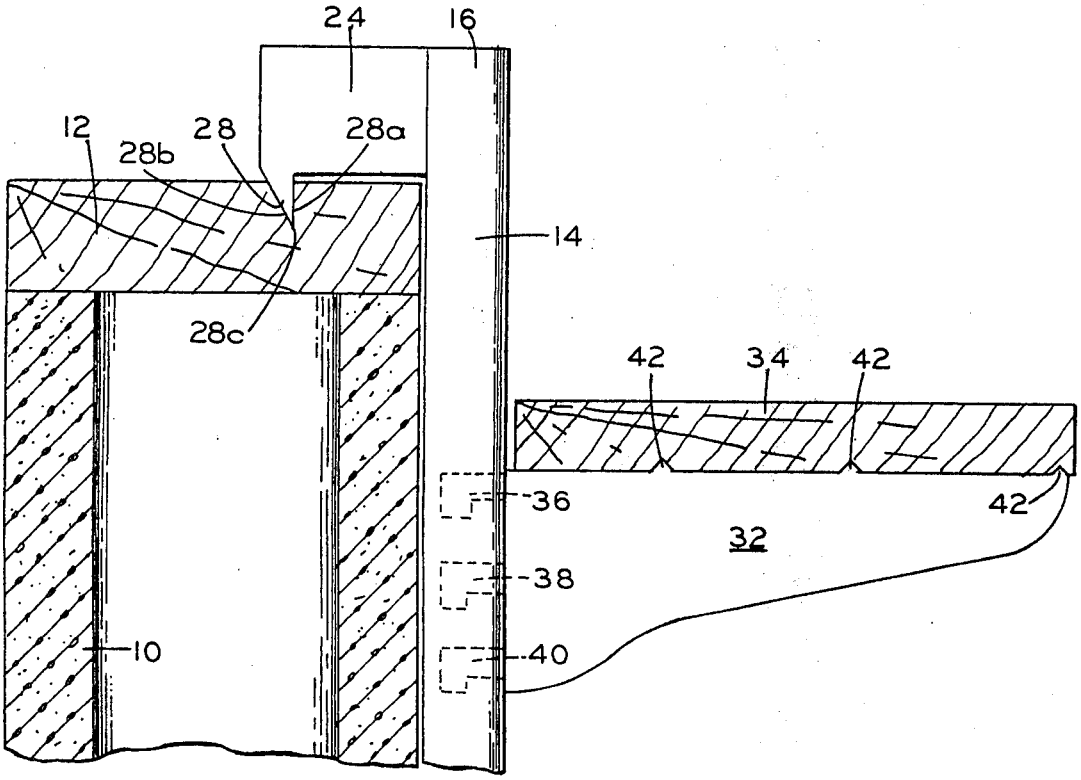
FIG. 2 is a fragmentary, sectional view of the system illustrated in FIG. 1 taken along line 2—2 thereof.
Figure 3:
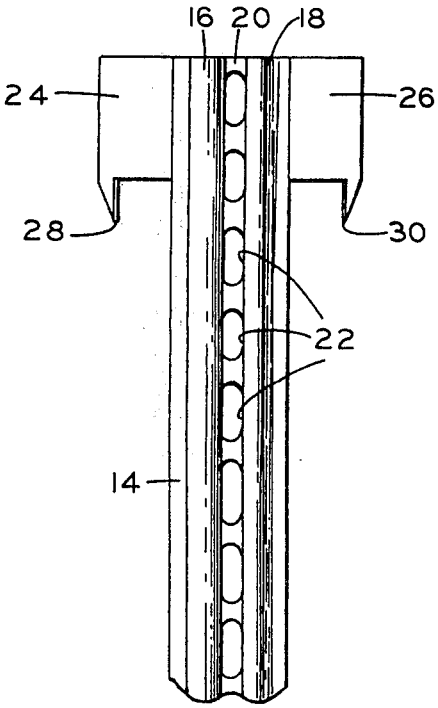
FIG. 3 is a fragmentary, elevational view of the upper portion of one of the vertically extending rail members illustrated in FIGS. 1 and 2.
Figure 4:
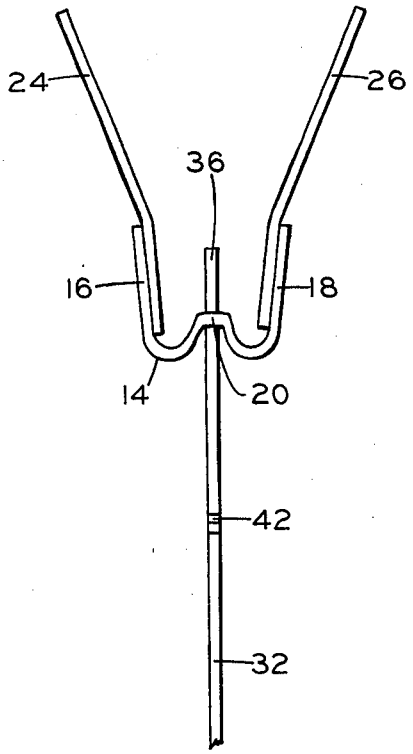
FIG. 4 is a slightly enlarged top plan view of the rail member illustrated in FIG. 3 showing an associated shelf supporting bracket affixed thereto.

The uppermost end of the rail member 14 is provided with a pair of outwardly extending generally vertical plate portions or tabs 24 and 26 which are typically designed to be formed from sheet metal stock and welded or otherwise suitably secured to the rail members 14 and to extend from the side walls 16 and 18, respectively of the rail member 14. In the preferred embodiment, the tabs 24 and 26 are disposed at a slightly greater angle to one another than the angle between the side walls 16 and 18 of the rail members 14. The distal edges of the tabs 24 and 26 are formed to include prongs 28 and 30, respectively. The prongs 28 and 30 extend generally parallel to the longitudinal axis of the associated rail member 14. As shown in FIG. 2, the prong 28 includes a first edge portion **28*a* in generally parallel, facing relationship with the rail member 14. The prong 28 also includes a second edge portion 28*b* which forms an acute angle with the first edge portion 28*a* and intersects the edge portion 28*a* at point 28*c*. As shown in FIG. 3, the prong 30 is formed in a manner similar to the prong 28**.

The rail members 14 are typically formed from sheet metal stock and may be of any desired lengths. It has been found that excellent results have been achieved by utilizing galvinized steel stock of fourteen gauge thickness. The resultant structure is thereby strong and rugged and will have an extremely long life cycle.

In use, at least two rail members 14 are deemed necessary to provide the primary supporting structure for the shelving system clearly illustrated in FIG. 1. It will be understood, that the system employed may be varied to accommodate increased loads by increasing the number of rail members and spacing the rail members closer together. Initially, the first of the rail members 14 is positioned in such a manner that the free edges of the rail members 14 are juxtaposed to the exposed wall surface and the prongs 28 and 30 are disposed to merely begin to slightly pierce or puncture the top surface of the wooden plate 12. As soon as the position of the rail member is thus determined, the rail member is raised or lifted one or two inches above the upper surface of the wooden plate 12 and is then thrust downwardly causing the prongs 28 and 30 to pierce and be firmly embedded in the wooden plate 12.

The position of the next adjacent rail member is selected in a similar manner to that explained above and the rail member 14 is then secured in place. In certain instances where longer shelves are required or desired, or additional load requirements are anticipated, additional rail members 14 are positioned and similarly secured.

After the desired number of rail members 14 are suitably positioned and secured in place, shelf brackets 32 are manually affixed to the rail members 14 at the desired vertical spacing for the eventual support function of associated shelving members 34, preferably formed of wood stock. The shelf brackets 32 are typically formed of sheet metal stock and include a plurality of outwardly and downwardly extending spaced fingers 36,38, and 40. The spacing of the fingers 36, 38, and 40 is typically the same as the spacing between the slots or apertures 22 of the rail members 14 so that the fingers may be readily received by the associated slots. It will be appreciated that the installation procedure of the brackets 32 to the supporting rail members 14 is accomplished by initially positioning the brackets 32 so that the fingers 36, 38, and 40 are aligned with an equivalent number of slots or apertures 22 of the rail member 14. As soon as the alignment occurs, the bracket 32 is moved toward the rail member 14 causing the fingers 36, 38, and 40 to be received by and within associated slots 22. When the outer ends of the fingers 36, 38, and 40 have completely traversed the slots 22, the bracket 32 is then lowered slightly to allow the outwardly and downwardly extending ends of the fingers 36, 38, and 40 to hook around the opposite inner surface of the rail member 14 and thus effectively secure the bracket 32 to the rail member 14. It will be noted that in the secured position, the bracket 32 is maintained against any downward rocking movement. However, in the illustrated embodiment, the bracket 32 may be slightly pivoted or moved about a vertical axis. Such movement is limited by the outer sidewalls of the U-shaped web 20 of the rail member 14.

The remaining shelf brackets are then similarly affixed to the rail members 14 preparatory to receiving the shelving members 34.

The upper edges of the brackets 32 are provided with a plurality of spaced-apart upwardly projecting teeth or prongs 42 to assist in militating against any relative movement of the brackets and the associated shelving members when in operative position.

Finally, the shelving members 34 are positioned in supported relationship on the brackets 32. In certain instances, the weight of the shelving members 34 may be sufficient to cause the teeth 42 of the brackets 32 to penetrate or bite into the lower surface thereof. This effect will be, indeed, supplemented when materials to be stored are placed on the shelves.

It will be appreciated from the foregoing description that the invention has resulted in a shelving system comprised of a minimum number of components which can be installed quickly, economically, and without the requirements of any particular expertise or tools or fasteners. Also, the system is one which can be easily removed and installed in another location with the same ease as initial installation.

In accordance with the provisions of the patent statutes, the principle and mode of operation of the invention has been explained and what is considered to represent its best embodiment has been illustrated and described. It should, however, be understood that the invention may be practiced otherwise than as specifically as illustrated and described without departing from its spirit and scope.

I claim:

1. A shelving system for supporting horizontally disposed shelving adjacent a vertical wall surface having a horizontally extending sill, the system including at least a pair of spaced-apart vertically extending rail members each having a pair of spaced apart, interconnected side walls, said rail member having means for receiving shelving support brackets; and means attached to the upper end of said rail members for releasably securing said rail members to the horizontally extending sill, said securing means including a separate generally vertical plate portion extending outwardly from the upper end portion of each of said side walls of said rail members, each of said plate portions provided with downwardly extending prong means adapted to securely engage the horizontally extending sill for supporting said rail member adjacent the vertical wall beneath the sill and militating against any swinging movement of said rail member along the wall surface.

2. The invention defined in claim 1 including shelving support brackets and means for connecting said brackets to said receiving means of said rail members.

3. The invention defined in claim 2 wherein said connecting means includes a plurality of spaced aperture means.

4. The invention defined in claim 3 wherein said brackets include fingers for selective engagement with said aperture means.

5. The invention defined in claim 2 wherein said brackets include upstanding prong means adapted to engage a lower surface of a shelf supported by said brackets.

6. The invention defined in claim 1 wherein said plate portions are disposed at an angle to one another.

7. The invention defined in claim 1 wherein said spaced apart side walls are interconnected by an interconnecting web portion.

8. The invention defined in claim 7 wherein said web portion contains a series of spaced-apart apertures, and shelving support brackets having means for connecting said brackets to the spaced-apart apertures of said web portion.

9. A shelving support member comprising an elongate rail member adapted to be vertically supported adjacent a vertical wall surface having a horizontally extending sill, said rail member having a longitudinal axis and a pair of spaced apart, interconncted side walls, said rail member including means for receiving shelving support brackets, said support member including a separate plate portion generally parallel to the longitudinal axis of said rail member and extending outwardly from one end portion of each of said side walls of said rail member, each of said plate portions provided with prong means spaced from said rail member for anchoring said support member to an associated horizontal support.

10. The invention defined in claim 9 wherein said receiving means includes a plurality of spaced apart apertures.

11. The invention defined in claim 10 wherein said spaced apart side walls are interconnected by an interconnecting web portion containing said plurality of spaced apart apertures.

12. The invention defined in claim 11 wherein said web portion is generally U-shaped in cross-section.

13. The invention defined in claim 7 wherein said web portion is generally U-shaped in cross-section.

14. The invention defined in claim 1 wherein said prong means includes a first edge portion in facing relationship with said rail member and generally parallel with said rail member and a second edge portion formed at an acute angle relative to said first edge portion.

15. The invention defined in claim 9 wherein said prong means includes a first edge portion in facing relationship with said rail member and generally parallel with said rail member and a second edge portion formed at an acute angle relative to said first edge portion.

16. The invention defined in claim 9 including shelving support brackets and means for connecting said brackets to said receiving means of said rail member.

17. The invention defined in claim 16 wherein said brackets include upstanding prong means adapted to engage a lower surface of a shelf supported by said brackets.

* * * * *